US005318330A

United States Patent [19]

Dombrowski

[11] Patent Number: 5,318,330

[45] Date of Patent: Jun. 7, 1994

[54] DEVICE FOR PICKING UP AND CONTAINING DOG EXCRETA

[76] Inventor: Thaddeus Dombrowski, 916 E. Watson Dr., Tempe, Ariz. 85283

[21] Appl. No.: 144,032

[22] Filed: Nov. 1, 1993

[51] Int. Cl.[5] ..... A01K 29/00; E01H 1/12

[52] U.S. Cl. ..... 294/1.3; 15/104.8; 15/257.6; 294/55

[58] Field of Search ..... 294/1.3-1.5, 294/55; 15/104.8, 257.1, 257.2, 257.6, 257.7; 206/223, 496; 220/318, 345, 346, 351; 229/9, 19, 23 BT

[56] References Cited

U.S. PATENT DOCUMENTS

| | | | |
|---|---|---|---|
| 1,990,026 | 2/1935 | Glen | 15/257.6 |
| 3,382,523 | 5/1968 | Parsisson | 15/257.2 |
| 3,841,684 | 10/1974 | Fleishman | 294/1.3 |
| 3,877,742 | 4/1975 | Hatfield | 294/1.3 X |
| 4,017,015 | 4/1977 | Jefferson | 294/1.3 |

FOREIGN PATENT DOCUMENTS

| | | | |
|---|---|---|---|
| 3301761 | 8/1984 | Fed. Rep. of Germany | 294/1.3 |
| 1021750 | 3/1966 | United Kingdom | 15/257.2 |
| 2155744 | 10/1985 | United Kingdom | 294/1.3 |

*Primary Examiner*—Johnny D. Cherry
*Attorney, Agent, or Firm*—Warren F. B. Lindsley

[57] ABSTRACT

A device for scooping up and containing dog excreta for later removal comprising two engaging parts one part of which serves as a scoop for use in scraping and excreta into the hollow interior of the other part. A handle comprising two parts is provided which parts individually serve to each support a different one of the parts and when the parts are moved into engagement interlock to form a single handle for supporting the assembled device.

6 Claims, 2 Drawing Sheets

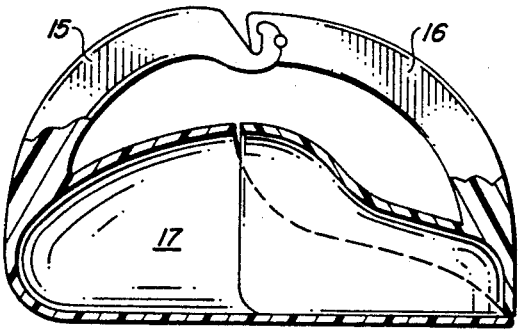
FIG. 7
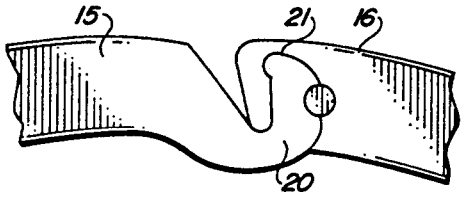
FIG. 10A
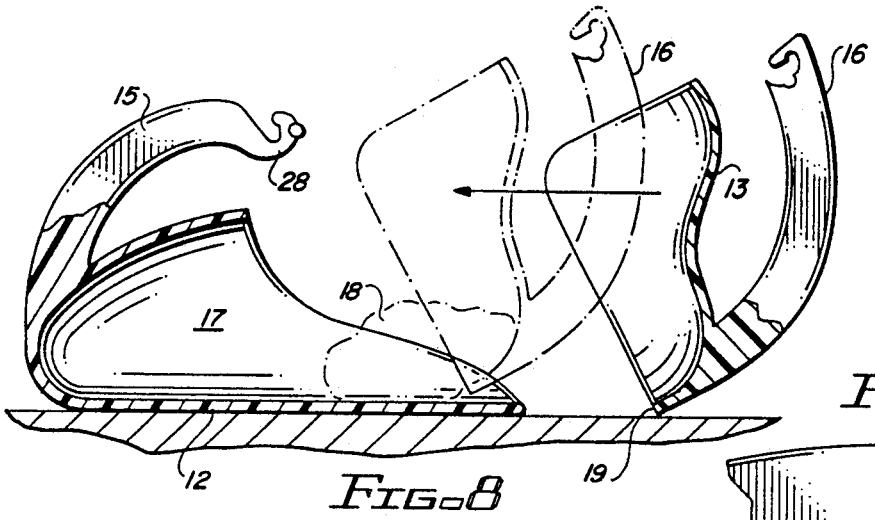
FIG. 8
FIG. 10B
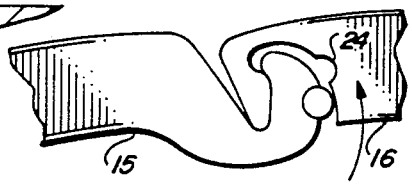
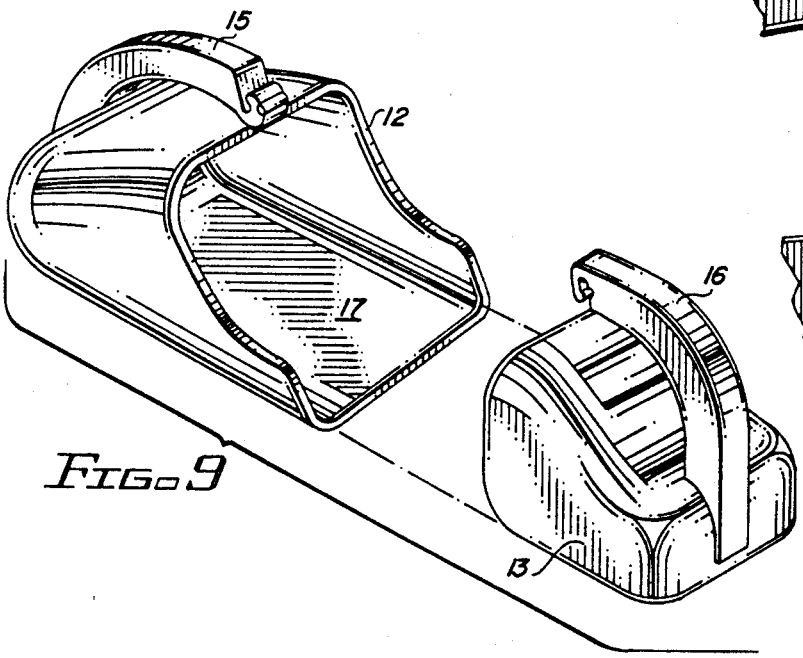
FIG. 9
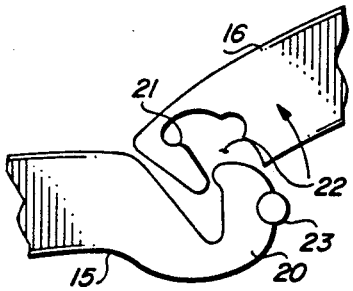
FIG. 10C

DEVICE FOR PICKING UP AND CONTAINING DOG EXCRETA

BACKGROUND OF THE INVENTION

This invention relates to a device for picking up and containing animal excreta and more particularly to a device which not only is useable in picking up dog waste but also is used to contain it in a carrying object until it can be disposed of.

Heretofore, pet owners have carried a small scoop or shovel for picking up dog waste particularly when deposited on private or public property and then depositing it in a bag carried by the party exercising the leashed controlled animal for later disposal. Needless to say, this is an awkward and distasteful procedure.

DESCRIPTION OF THE PRIOR ART

The handling and disposal of dog excreta particularly when deposited by a leashed controlled dog on private or public land is not only a legal requirement in most places but a good neighborly deed which most pet owners want to perform.

Small scoops and bags have been provided by the trade for this use but are inconvenient and costly to use since they are disposable.

SUMMARY OF THE INVENTION

This invention relates to carrying devices for animal excreta but more particularly to a dual purpose scoop and excreta carrying device wherein the scoop forms a part of the carrying device.

It is, therefore, one object of this invention to provide a new and improved dual purpose scoop and animal waste carrying device.

Another object of this invention is to provide a reusable carrying case comprising a housing for carrying the animal waste after it has been scooped up by use of a part thereof which part serves the dual purpose of the scoop and a part of the carrying case.

A further object of this invention is to provide a new and improved carrying case for dog excreta employing a handle for the carrying case comprising two interlocking parts one part of which supports the storage portion of the housing and the other part of which supports the scoop portion of the housing when the parts of the housing are separated.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 7 is a cross sectional view of FIG. 1 taken along the line 7—7;

FIG. 8 is a cross sectional exploded view similar to FIG. 7 with the handle portions separated;

FIG. 9 is an exploded view of the carrying case illustrating the scoop disconnected from the storage portion of the carrying case; and FIGS. 10A–10C illustrate the handle in various steps of disengagement.

DESCRIPTION OF THE PREFERRED EMBODIMENT

Figure 1:
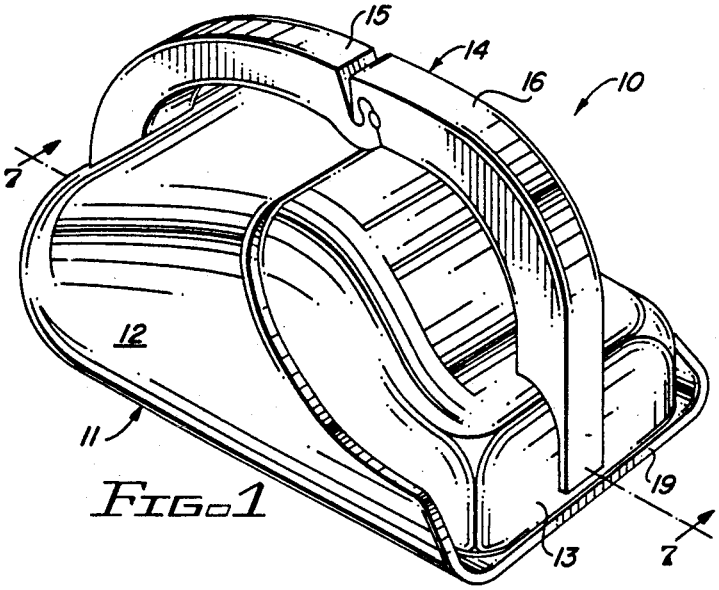
FIG. 1 is a perspective view of the carrying case and dual purpose scoop for handling dog excreta and embodying the invention.
Figure 5:
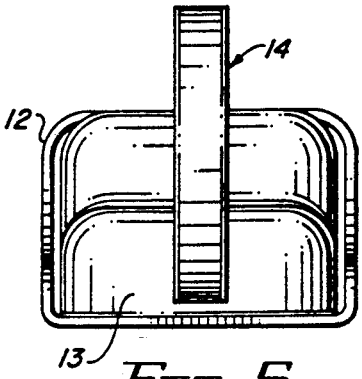
FIG. 5 is a front view of FIG. 1.
Figure 2:
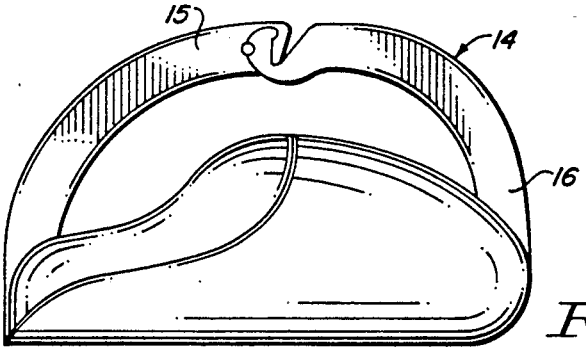
FIG. 2 is a right side view of FIG. 1.
Figure 3:
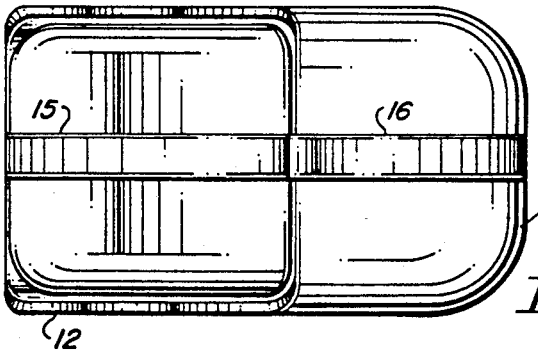
FIG. 3 is a top view of FIG. 1.
Figure 6:
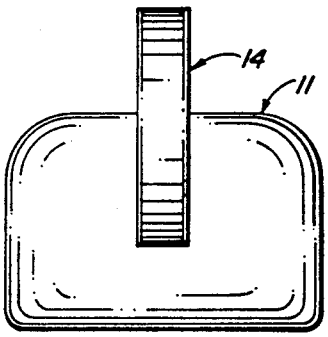
FIG. 6 is a back view of FIG. 1.
Figure 4:
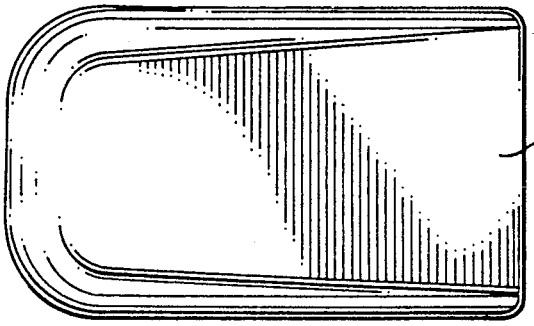
FIG. 4 is a bottom view of FIG. 1.

Referring more particularly to the drawings by characters of reference, FIGS. 1–6 disclose a carrying device or case 10 for retrieving, containing and storing of animal waste or excreta until disposed of. Case 10 comprises a housing 11 formed of two engaging parts 12 and 13 which are held together by a handle 14 formed by interlocking parts 15 and 16 the interaction of which is shown more clearly in FIGS. 7–10C.

As shown more clearly in FIG. 9, carrying case 10 comprises two parts 12 and 13 which fit together to form an enclosed space 17 for containing the retrieved waste or excreta 18 until later disposed of.

Part 13 of housing 11 loosely fits into part 12 of the housing and is held together by the interlocking of parts 15 and 16 of handle 14. Edge 19 of part 13 when separated from part 12 of the housing forms an edge for pushing and/or scooping up excreta 18 into the hollow interior of part 12 of the housing, as shown in FIG. 8 of the drawing.

When the excreta is pushed into the hollow interior of part 12 of housing 11, part 16 of handle 14 is engaged with part 15 of the handle in the manner shown in FIGS. 10A–10C to interlock parts 12 and 13 of housing 11 together thereby containing the excreta in a satisfying carrying arrangement until later disposed of.

As noted from FIGS. 1, 7 and 9 and particularly from FIGS. 10A–10C, the spaced ends of parts 15 and 16 of the handle are secured to the associated parts 12 and 13 of the housing with the juxtapositioned ends of parts 15 and 16 of the handle being formed to interlock with each other.

FIGS. 10A–10C illustrate that part 15 is provided with a hook nose configuration 20 which engages with edge 21 of groove 22 formed in the associated end of part 16 of handle 14. When the associated ends of handle 14 engage and interlock, they move into that position by the sequential movements illustrated in FIGS. 10C, 10B and 10A of the drawings.

To aid in maintaining a frictional engagement of nose 20 of part 15 with groove 22 of part 16 of handle 14, a protrusion 23 is provided at a point along the periphery of nose 20 which engages with an indentation 24 in the edge or periphery 21 of groove 22.

Protrusion 23 may form a part of nose 20 of part 15 or it may be a separate distinct cylindrical part of a different softer material that is secured to the periphery of nose 20 of part 15 of the handle.

Since the carrying case may be molded out of a suitable plastic material, the engaging parts of the case may be resilient enough to give a little when the associated ends of parts 15 and 16 of the handle engage.

In accordance with the invention claimed, a dual purpose device is provided the housing of which comprises two loosely engaging parts. One of the parts forms a scoop for use in scraping up and pushing the excreta into the other part of the housing.

It should be noted that the individual parts of handle 14 are each arranged to extend over the associated part of the device and each forms a handle for that particular part of device 10. When the parts of device 10 are pushed together and parts 15 and 16 of the handle engage and interlock, the two parts 15 and 16 form together a handle for the assembled device.

Further, the interlocking of the parts of handle 14 together also locks part 13 together with part 12 of the housing to prevent the contents of the housing from falling out of the device when carried by a user.

Although but one embodiment of the invention has been illustrated and described, it will be apparent to those skilled in the art that various changes and modifications may be made therein without departing from the spirit of the invention or from the scope of the appended claims.

What is claimed is:

1. A device for use in picking up and containing animal excreta comprising:

a housing, said housing comprising a first engaging part and a second engaging part which together form an enclosed hollow container, said first engaging part comprising a scoop which when disengaged from said housing is useable for scraping up and pushing into said second engaging part animal excreta and containing it in said hollow container until disposed of, and an elongated handle comprising two interlocking parts with each interlocking part having two ends, with each interlocking part being secured at one of said ends to a different one of said engaging parts and the other of said ends being juxtapositioned for detachably interlocking with each other to detachably engage said engaging parts to form the enclosed hollow container.

2. The device set forth in claim 1 wherein:

said interlocking parts of said handle extend over said hollow container and when engaging the juxtapositioned ends of said handle interlock over approximately the center of the device.

3. The device set forth in claim 2 wherein:

each interlocking part of said handle extends over the associated engaging part of said housing to which it is secured at one end thereof for aid in handling said engaging part of said housing when disconnected from the other of said engaging parts.

4. The device set forth in claim 1 wherein:

one of said juxtapositioned ends of said interlocking parts is configured with a hook nose for detachably interlockingly engaging a groove in the juxtapositioned end of the other interlocking part.

5. The device set forth in claim 4 wherein:

said hook nose of said one of said juxtapositioned ends of said interlocking parts pivotally engages the groove in the juxtapositioned end of said other of said interlocking parts.

6. The device set forth in claim 4 wherein:

said hook nose is provided with a protrusion along its periphery for engaging with a slot in the periphery of said groove for firmly holding said interlocking parts of said handle together in interlocking arrangement.

* * * * *